US005198803A

United States Patent [19]

Shie et al.

[11] Patent Number: 5,198,803

[45] Date of Patent: Mar. 30, 1993

[54] LARGE SCALE MOVIE DISPLAY SYSTEM WITH MULTIPLE GRAY LEVELS

[75] Inventors: Jin S. Shie; Jiann C. Horng, both of Hsinchu; Kwang S. Tone, Kaouhsing; Kuang C. Tao, Hsinchu; Yann T. Hsieh, Hsinchu; Shou C. Chiou, Hsinchu; Der C. Yue, Hsinchu, all of Taiwan

[73] Assignee: Opto Tech Corporation, Taiwan

[21] Appl. No.: 533,855

[22] Filed: Jun. 6, 1990

[51] Int. Cl.[5] ..... G09G 3/32

[52] U.S. Cl. ..... 340/782; 340/762; 340/815.03

[58] Field of Search ..... 340/762, 782, 767, 815.03, 340/815.12, 815.27, 793; 315/307

[56] References Cited

U.S. PATENT DOCUMENTS

| | | | |
|---|---|---|---|
| 3,564,135 | 2/1971 | Weimer | 358/241 |
| 4,190,836 | 2/1980 | Kimura et al. | 340/782 |
| 4,659,967 | 4/1987 | Dahl | 340/782 |
| 4,866,430 | 9/1989 | Chek | 340/762 |
| 5,008,657 | 4/1991 | Hanson et al. | 340/767 |

FOREIGN PATENT DOCUMENTS

| | | | |
|---|---|---|---|
| 0067522 | 6/1977 | Japan | 340/782 |
| 0072497 | 6/1978 | Japan | 340/782 |

*Primary Examiner*—Ulysses Weldon
*Assistant Examiner*—M. Fatahiyar
*Attorney, Agent, or Firm*—Cushman, Darby & Cushman

[57] ABSTRACT

A large scale electronic display board system for displaying images in response to an image signal. The system has a light emitting diode (LED) display for displaying images in multiple gray levels. The LED display has an N×M array of LEDs. Each LED has a corresponding driving circuit which linearly controls the gray level of the LED.

2 Claims, 12 Drawing Sheets

LARGE SCALE MOVIE DISPLAY SYSTEM WITH MULTIPLE GRAY LEVELS

BACKGROUND OF THE INVENTION

The present invention relates to a large scale movie display system with multiple gray levels which comprises specific circuits, e.g. negative feedback or image current circuits, to control the brightness of the LEDs in proportion to the analog signals produced by the image information. The overall circuit can be used to carry out presetly, or real-timely the programmably controlled image display through a compact personal computer or microprocessor for attractive dynamic image advertising and displaying effects.

At present, electronic displaying boards are becoming more and more popular. In general, a conventional television set may well serve the displaying functions. However, when used in large scale displaying boards, the functions provided by such conventional television set would be worse than the electronic displaying boards. In particular, the electronic displaying boards are better at providing a programmably controlled moving image display for advertising, announcing or indicating purposes, such as for diversified uses in stock markets, airports and communication stations for displaying time schedules and information, and as the large scale display for use in stadiums.

These conventional electronic displaying boards are composed of array of visible light dots which, in the past, are composed by a plurality of incandescent bulbs. The type of electronic displaying board has one disadvantage that the board would remain a residual image of the preceding image when changed to a new image since the heating time constant of each of the bulbs is too long. This condition results in that pictures displayed can not be changed fast. Moreover, the current consumption and power supplied for the above device are so great that upon driving, the current must be first amplified by power elements. Further, owing to the high rate to damage of the bulbs and frequent replacements, it is time- and labor-consuming in maintenance.

The recent discovered electronic displaying boards composed of the LED array have overcome the disadvantages resulting from the array of incandescent bulbs. The electronic displaying board with LEDs has the advantages of a longer usage life (more than ten years), reduced dimensions, and smaller operating voltage (1.5-2.4 V) and current (5-20 mA). Further, it can provide red, yellow, and green colors, for displaying; the spectra thereof narrower being such that the visual sensitivity to the eyes is stronger. Therefore, this type of electronic displaying board is becoming more and more popular for advertising and demonstration purposes.

The LEDs are one type of the solid state electronic elements and thus, the small panel of LED array ($5\times7$ or $8\times8$) can be quite easily manufactured and packaged by means of automatic machines. Further, the diodes have a reverse blocking characteristic such that they can form a bridged array, as shown in the circuit of FIG. 11, which is a more commonly used circuit at the present. In the circuit, scanning function is achieved via synchronous multiplexing in the X and Y directions and thereby certain programmed stationary graphic displays can be executed.

However, since the present large scale electronic LED displaying boards can only provide two gray levels, that is, either full bright or full dark, they are capable only of graphic display. When used for displaying images, the images look like cartoon pictures without stereo feeling in different gray levels. This is due to the strong non-linear current-voltage characteristic of the LEDs, which is, therefore, rather difficult to have the current-voltage characteristic curve of the LEDs linearized to produce different brightness. If controlling a small LED array, such as $4\times4$, in a half tone manner, then 16 gray levels of the display can be obtained. However, the number of arrays in the displaying board will thus be reduced so as to affect the resolution of the image.

In addition, with respect to a displaying board with single dot LED gray level, the variation in mean brightness of the display can be controlled by means of controlling the operating time of fast flashing pulses. Under this condition, if the flashing frequency of the pulses is higher than the frequency for persistence of vision, then, as viewed to human eyes, the variation in brightness will be in proportion to the operating time of these pulses. This manner can be readily accomplished in a displaying board with small LED array. However, in large scale LED displaying boards, such as displaying screen in sports field, there are drawbacks difficult to overcome in design. This will be described by way of the following example:

Displaying screen: $N\times N$ array

Specifications of a single LED: 1.8V, 20mA

Frame rate: 30 frames/sec (number of frames per second)

Pixel dwell time: $T=1/(30\times N^2)$

To maintain equal visual brightness, the transient trigger current I for each of the LEDs should meet the following equation:

$$I\times T=20mA\times(1/30)$$

that is, $$I=20mA\times(1/30)\times30\times N^2=20\ mA\times N^2$$

When the frame is in the form of an array of $256\times256$ pixels, then $I=20\ mA\times256\times256=20\times64=1280\ A$ which is found to be impossible.

If LEDs of 5 mA are used, the transient trigger current for each LED must be as high as 320 A which is still impossible because the presently available LEDs have a maximal transient current lower than 100 A and requires a driving voltage higher than 100 V.

Moreover, as well as known, each LED itself has an inherent serial resistance of about 1 ohm, which is formed by the chip resistance between the P-N interface and the substrate of the LED, and the contact resistance between the packed silver glue and the chip surface during packing. When the LED is supplied by continuous direct current, the current flowing therethrough is about 20 mA as described in the above specification, and thus both the voltage drop thereof and the power consumption are relatively low. However, when the LED is activated by means of pulsed voltage source for transient switching on, the LED would have a large voltage drop of about 1000 V due to its enormous transient current, which is infeasible. Even in the case where such high voltage driving is possible, the power consumption of the LED would be thousand times that required for an ideal LED. Under such condition, the light emitting efficiency of the LED would be sharply decreased due to the temperature rise at the interface or the LED would be damaged due to such high temperature rise.

In brief, gray level control of the LED brightness by means of controlling the width of the operating time of the , transient flashing pulse will become infeasible in design as the dimensions (N x N) of the display increase. This is the reason why the large scale LED image (not graphic) displays are not yet introduced in the market.

SUMMARY OF THE INVENTION

The object of the present invention is to provide a large scale movie display system with multiple gray levels which can drive continually the composed LEDs of each of the pixels by lower current and control programmatically the brightness thereof. Further, the refresh of frame is executed by a digital/analog converter (D/A converter) to effect picture changes for moving images.

Further objects and advantages of the present invention will become apparent as the following description proceeds, and the feature of novelty which characterizes the invention will be pointed out with particularity in the appended claims annexed to and forming a part of the invention.

BRIEF DESCRIPTION OF THE PREFERRED EMBODIMENT

Figure 1A:
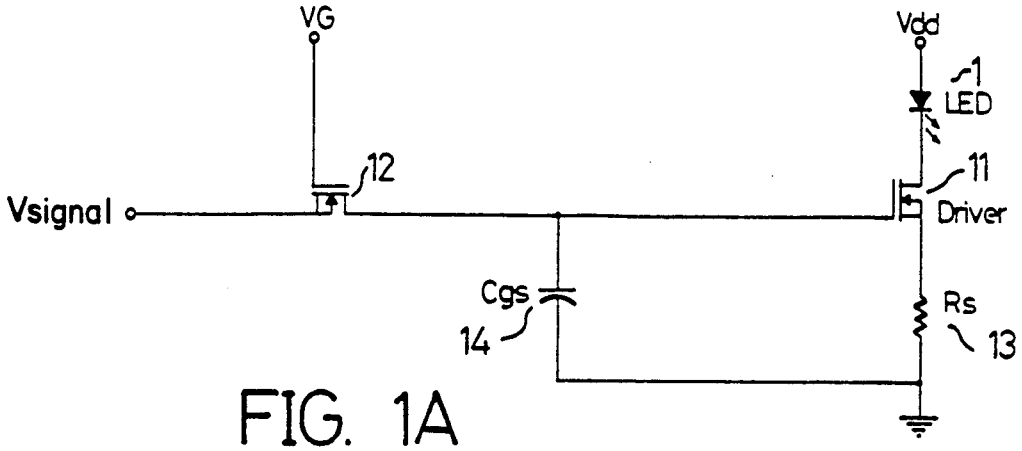
FIG. 1*a* is a driving circuit diagram of the LED in accordance with the present invention.
Figure 1B:
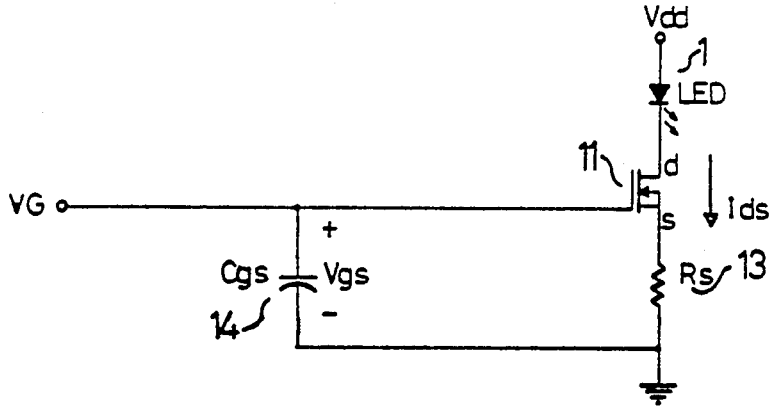
FIG. 1*b* is a driving circuit diagram which is a part of the circuit of FIG. 1*a;*
Figure 1C:
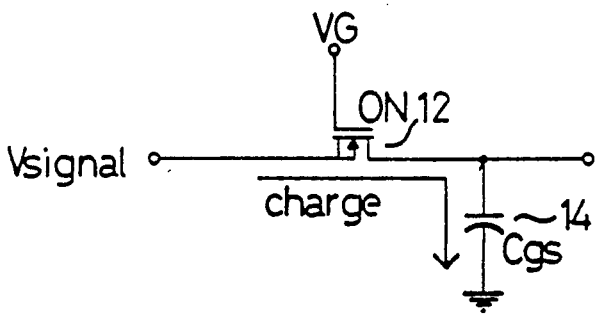
FIG. 1*c* shows a refreshing circuit according to the present invention which is a part of the circuit of FIG. 1*a;*

The present invention discloses a large scale movie display with multiple gray levels of which the basic unit is a light emitting diode 1 (LED) and its driving circuit, as shown in FIG. 1*a*. The driving circuit comprises a pair of metal oxide semiconductor field effect transistors (MOSFET) 11 and 12 wherein one 11 is used for driving the LED 1 and the other one 12 is used for controlling signal refreshment, a feedback resistor Rs 13 and a holding capacitor 14. To describe the operation of the circuit, the circuit is divided into two parts as shown in FIG. 1*b* and 1*c*. The respective operations are described as follows:, (1) FIG. 1*b* shows an LED driving circuit which includes a driving MOSFET 11, a feedback resistor (Rs) 13, and a holding capacitor (Cgs) 14.

Due to the characteristic of the MOSFET, the voltage Vgs across the capacitor Cgs 14 will determine the conduction degree between the drain (D) and the source (S) gates of the MOSFET 11, that is, the greater the Vgs is, the higher the conduction degree is and the smaller the Vgs, the lower the conduction degree is. Accordingly, the current Ids in the loop formed of Vdd, LED 1, the MOSFET 11 and Rs 13 can be controlled by Vgs which is proportional to the value of Ids. As a result, the current passing through the LED is under the control of Vgs and the brightness of the LEDs in different gray levels can be shown in a large scale LED array to produce a stereo sense image display.

The value of Vgs is controlled by the charging and discharging of the capacitor Cgs 14. Thus, it is considered that the voltage levels in the capacitor Cgs 14 be equivalent to the gray levels on the display. In the array of the present invention, each of the LEDs are incorporated with the driving circuit mentioned above.

(2) FIG. 1*c* shows a signal refreshing circuit which includes a control MOSFET 12 and a holding capacitor 14 (the same as that of the driving circuit above.)

In FIG. 1*c*, when a voltage signal $V_{signal}$ is input and the control MOSFET 12 is switched on, then a current will flow through the MOSFET 12 and thus the holding capacitor Cgs 14 starts to charge. When the capacitor 14 is charged to reach the voltage of the input signal, the control MOSFET 12 is immediately switched off. The holding capacitor Cgs 14 is thus blocked from charging continuously so that the potential of the holding capacitor Cgs 14 can be held.

As well as known, the potential of the capacitor 14 will be gradually reduced by discharging since a slight current leakage will flow from the capacitor 14. The leakage current, however, can be ignored when constantly and rapidly refreshing the input signal and the potential of the holding capacitor Cgs 14.

Since the present available control FET has a high conduction speed, it allows sufficient time for the holding capacitor Cgs 14 to be charged to the level equal to that of the input signal.

Unlike an incandescent bulb (not shown), the current (brightness)—voltage (input voltage) curve of a LED is rather non-linear. As shown in curve A of FIG. 2, as long as the input voltage is higher than the cut-off voltage, the current rises rapidly. It is therefore relatively difficult to show varying brightness by means of the LEDs.

Figure 2:
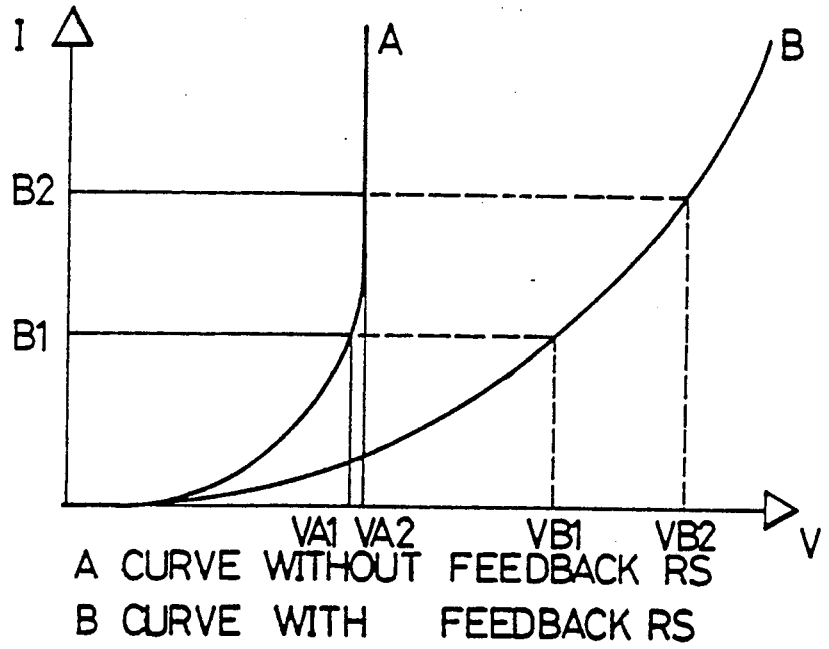
FIG. 2 shows the voltage brightness characteristic curves of an LED without and with a feedback circuit.

It can be seen from the curve A shown in FIG. 2, if the LED is to be lit in two different brightness B1 or B2, then the input voltage should be $V_{A1}$ and $V_{A2}$, respectively. The difference of the voltages $V_{A1}$ and $V_{A2}$ is rather small such that the current can be controlled only by using extremely limited voltage intervals and that slight shift in voltage will cause enormous changes in brightness.

To improve the non-linear relationship mentioned above, the present invention comprises a particular feedback circuit. After a feedback operation, the brightness-voltage curve of the LED is as shown as the curve B of FIG. 2. It can be seen from the curve B that if the LED is to be lit in B1 and B2 brightness, the required voltage will be $V_{B1}$ and $V_{B2}$, respectively, the intervals therebetween being apparently enlarged. Therefore, the control of the voltage , becomes easier.

The feedback operation of the present invention is achieved by means of a feedback resistor Rs 13 set between the source (S) of the driving MOSFET 11 and ground for negative feedback, as shown in FIG. 1*b*. The resistor Rs 13 neither consumes additional current nor reduces the light intensity of the LED 1, yet serves to expand the linear range of the controlled LED 1.

With the design of the present invention, the brightness of the LED array can be achieved for 256 gray levels. However in other designs, it is difficult to achieve gray level control and to give a stereo sense image display.

Figure 3:
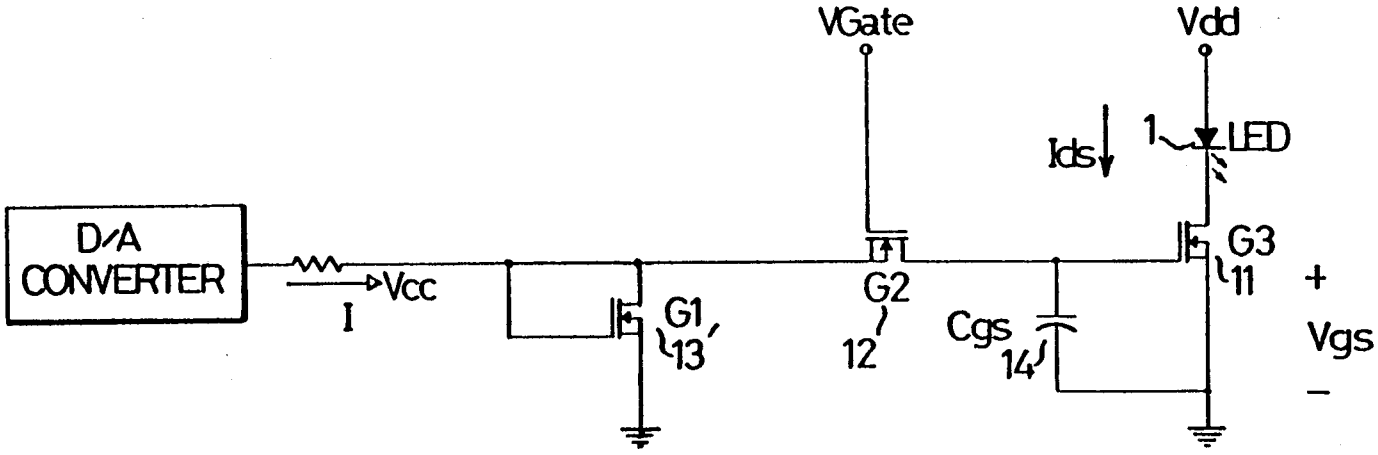
FIG. 3 is a circuit diagram of the image current in accordance with the present invention.

As shown in FIG. 3, the so called current image circuit can also be used to enhance the brightness linearization effect of the LED. The circuit of FIG. 3 shows an integrated circuit of the basic pixel displaying unit of another embodiment of the present invention which includes a small channel width MOSFET gate G1 13', a control MOSFET gate G2 12, a holding capacitor Cgs 14, a large channel width MOSFET gate G3 11 and a LED 1. Please note that the LED, the large channel width MOSFET gate, the holding capacitor Cgs and the control MOSFET gate are the same as those shown in FIG. 1*a* and the reference numbers thereof are identical to those of FIG. 1*a*. Only the small channel MOSFET G1 13' replaces the original feedback resistor Rs 13 of FIG. 1*a*. This current image method has the advantages of exampt the above mentioned feedback resistor 13, hence saving the real estate of the fabricated integrated circuit.

The input of the circuit is a current signal I which is the output of the prestage 2. The prestage 2 of this circuit is a combination of a digital-to-analog converter (D/A converter) and an operational amplifier which converts digital values into current signals and may be considered as a "current source", for the required input of the current image circuit.

The channel width of the gate G3 11 is designed to be 10 times (or other required times) that of the gate G1 13'. When the input current I passes through the small channel width MOSFET gate G1 13', a potential which is in direct proportion to the current I will be generated between the source and the drain gates of the MOSFET 13'. Further, at the moment when the control MOSFET G2 12 is switched on, the holding capacitor Cgs 14 is charged to store a potential equal to the potential, whereby the voltage difference Vgs between the gate and the source gates of the large channel MOSFET gate G3 11 is controlled. Further, since the channel width of the MOSFET G3 11 is ten times (for example) of that of the MOSFET G1, the current Ids between the drain and the source of the large channel MOSFET G3 11 will be ten times that of the input current I.

Through this approach, it is easier to convert the input digital signals into current signals as required to drive the LED 1 to emit light and maintain the LED driving current in linear relationship with the input digital signal, thus to achieve accurate control for brightness linearization effect. Moreover, by means of the design of the current image circuit of the present invention, the required input current intensity can be reduced and is easier to generate.

Figure 11:
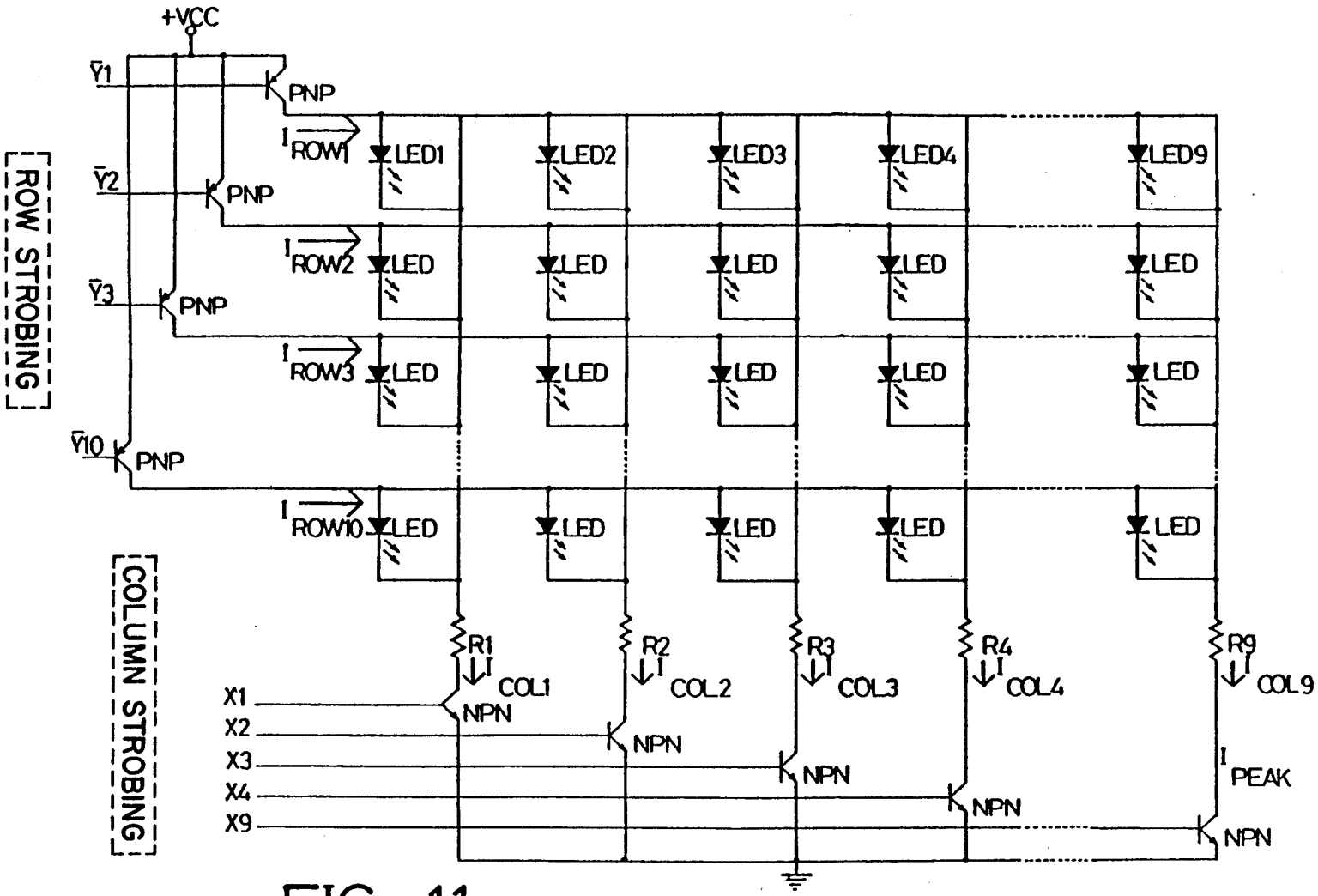
FIG. 11 (PRIOR ART)
FIG. 11 shows the structure of the conventional LED array used in large scale display.

The currently available LED array for use on the large scale display is as shown in FIG. 11 which effects scanning by means of the variations of X-directional and Y-directional signals to light different LEDs. For example, when the Y1 signal is in low level and X2 signal in high level, LED2 will be lit and in this way the array can be controlled to produce different characters or graphs. In the array, in order to satisfy the time requirement for persistence of vision for the human eyes, it is necessary ,to increase the input voltage such that greater current can be generated when each of the LEDs is lit as described hereinbefore. The higher current, however, will lower the light emitting efficiency and thus limit the brightness of the LEDs and the scanning speed.

In the design of the present invention, the disadvantages of the currently available array circuit are overcome by means of the array circuit with the single pixel operating principle mentioned above. The LED array circuit of the present invention can be seen in FIG. 4.

Figure 4:
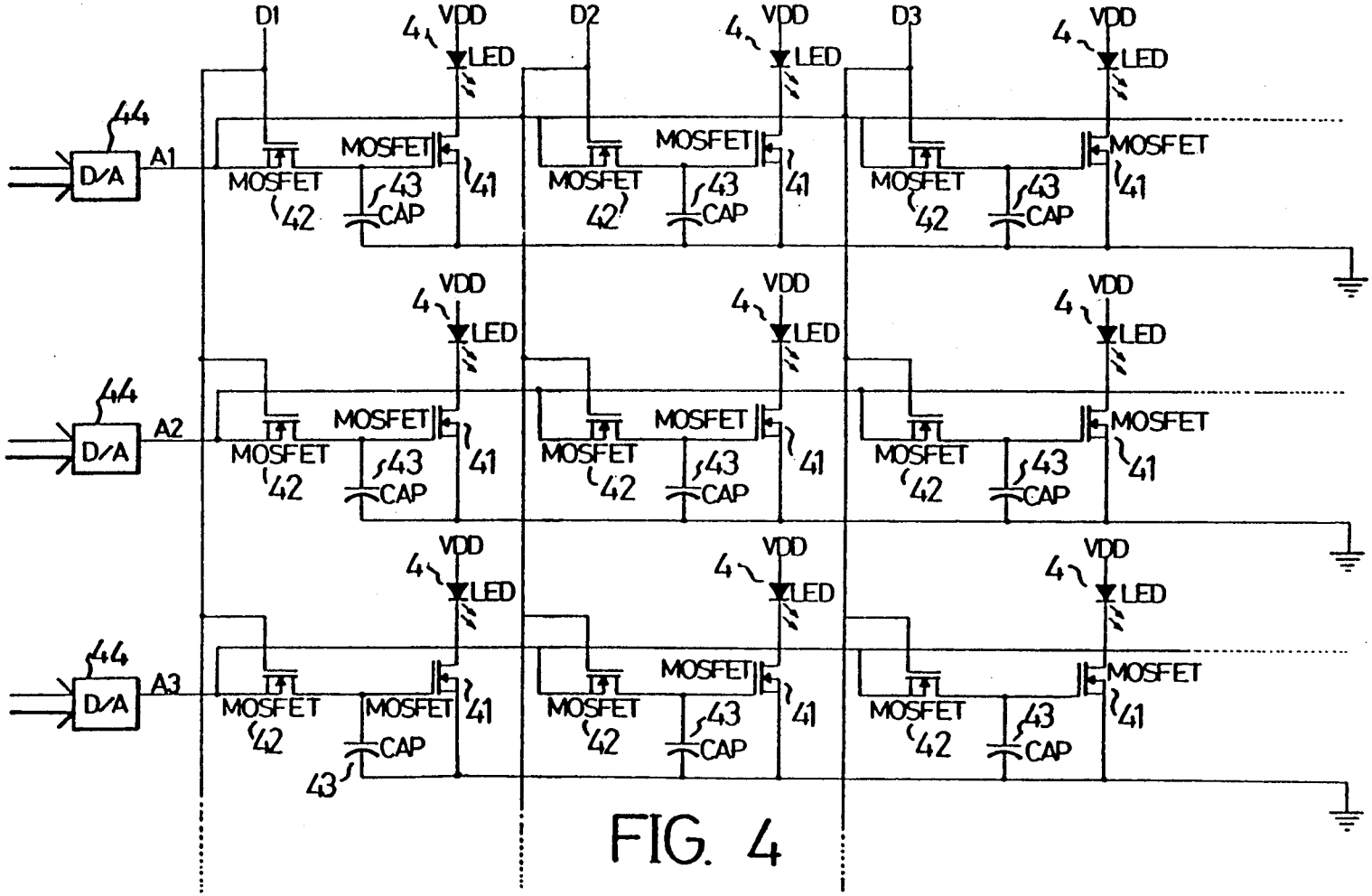
FIG. 4 is an LED array circuit using the single pixel operating principle of the present invention.

As shown in FIG. 4, it can be seen that individual LED is controlled by the single pixel operating principle. Each LED basic unit of the circuit is the similar to that shown in FIG. 3 which comprises a driving MOSFET 41, a controlled MOSFET 42 and a holding capacitor 43. The input digital signal is converted into an analog signal via a digital/analog converter (D/A converter]44. The brightness of the LEDs 4 is controlled by analog signals Al, A2,.. and the capacitors 43 hold the voltage such that the current flowing through the LEDs 4 are held constant. The array of the present invention is scanned by line scanning which is different from the conventional array. Since the gates of all the control MOSFETs in each column are connected together (see D1, D2, etc), during line scanning, all the control MOSFETs in a same column are switched on simultaneously such that the voltages in all the holding capacitors in the same column are refreshed at the same time. The operating principle for the LED array is described as follows:

First, the voltage values to be displayed are sent one by one to the D/A converters 44 of which the output are analog signals, then the analog signals are applied to the drain electrodes of the control MOSFETs 42. After analog signals are applied to each of the control MOSFETs 42 , respectively, each of the control MOSFETs in the first column is then switched on (that is, a positive potential is applied to a node D1), and each of the capacitors 43 in the first column start to charge, to generate potential, until the potential of each of the capacitor is nearly equal (with a threshold voltage difference of the MOS) to the analog voltages which make the driving MOSFETs 41 in conduction state. Then all the control MOSFETs 42 in the first column are switched off, namely, a zero potential is applied to the node D1. Since the capacitors 43 still remain at appropriate potentials, the driving MOSFETs 41 in the first column are still driving the LEDs 4, keeping them emitting light until the next frame of time, when the control transistors 42 in the first column are switched on again. The voltage stored in the capacitors 43 are therefore refreshed to change the brightness of the LEDs 4. The related timing of the above scanning will be described later in connection with the operation of the system.

After all the control transistors 42 in the first column are switched off, the input analog signals in each row are refreshed by the new image data. After this is completed, the control transistors 42 in the second column are then switched on and the capacitors 43 in the second column are charged similar to the 1st column as above mentioned. In this way, the image data are transferred to and stored in the capacitors one column after another in a way of line scanning and the entire image can thus be displayed.

It can be seen from the figure that the present invention utilizes a common anode circuit wherein all anodes of the LEDs 4 are connected to the point Vdd and all cathode thereof are connected to the driving transistors 41 respectively. Through this line scanning approach, not only flickering problems as associated with raster scanning, of the image is minimized, but also the frame rate can be increased by parallel processing. With the holding capacitor 43 in the circuit, the LEDs 4 are lit by means of direct current without having to drive them with high potential pulses. It is, therefore, possible to use lower voltage input, to reduce needless power consumption.

Figure 5:
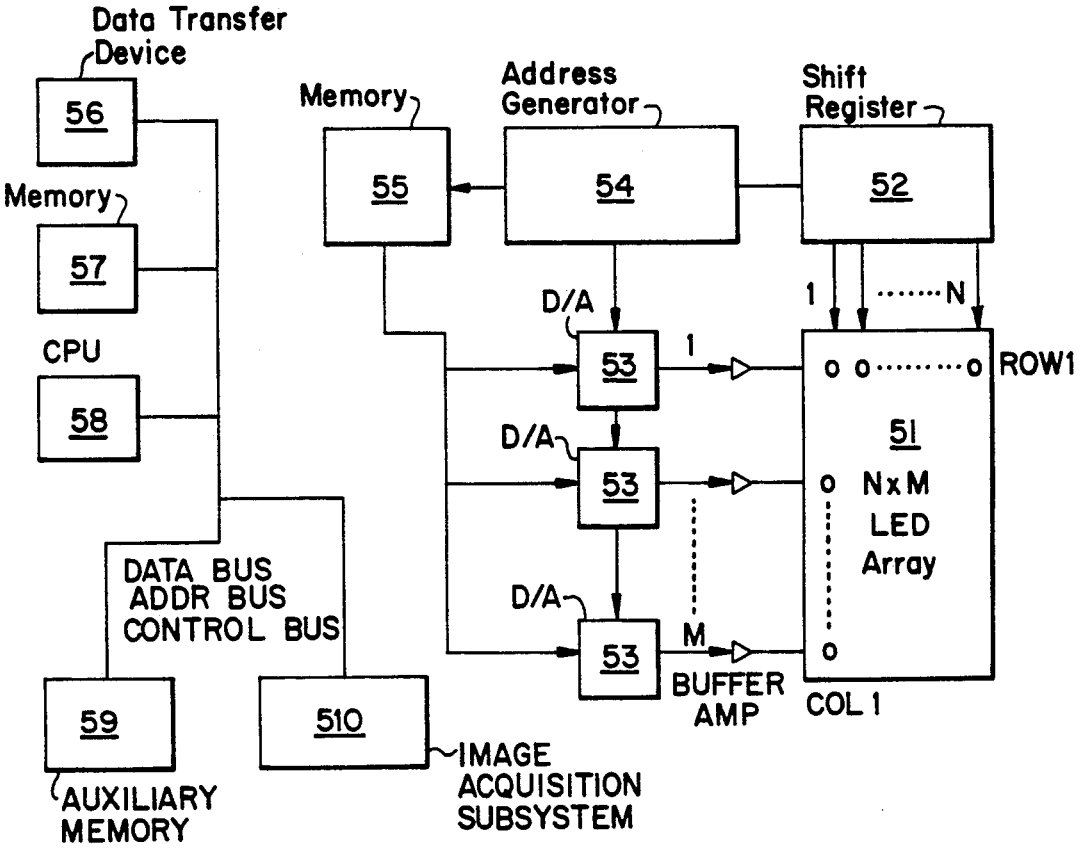
FIG. 5 is a block diagram of the large scale movie displaying system according to the present invention.

FIG. 5 shows a block diagram of the LED array display system of the present invention which comprises an N×M LED array display 51 (N≧2 M≧2), a line scanning shift register 52, M number of D/A converters 53 each having a register, a timing controller and address generator 54, a display memory subsystem 55, a data transfer device 56, a main storage 57, a central processing unit (CPU) 58, an auxiliary storage 59, and an image acquisition subsystem 510 The operation of the system will now be described:

As shown in FIG. 5, digital image data in different gray levels of the image to be displayed are first obtained through the image acquisition subsystem 510 and stored in the auxiliary storage 59 for later displaying purpose. To display an image program, the images stored in the auxiliary memory are stored into the main memory 57 in the desired sequence. If it is not necessary to keep the image data, they can be stored directly in the main storage The data transfer device 56 serves to deliver the image data stored in the main storage to the display memory subsystem 55 and the image data in the display memory subsystem 55 are then read and scanned by the timing controller and address generator 54 for displaying on the LED array 51.

The array structure of the present invention is different from the conventional array in that in the former, line scanning is used and the gates of the control transistors in each column is connected together (see D1 and D2 in FIG. 4) During scanning, the control transistors in the same column are switched on simultaneously such that all the holding capacitors in the same column have voltage refreshments at the same time. In this way, the frame rate is much higher than that in the case of raster scanning and the effect of high frame rate can thus be achieved.

The image data in the display memory subsystem 55 are read out by the timing controller and address generator 54 and then are written into the registers of the D/A converters 53. After the display data have been written into the registers of all the M number of D/A converters, pulsed signals are sent to switch all the control MOSFETs in a column n, the analog image signals of the information in different gray levels prepared by the D/A converters are then transferred to and stored int he corresponding holding capacitors such that the potentials in the holding capacitors may cause the corresponding LEDs to emit light in different brightness represented by the potentials.

Figure 6:
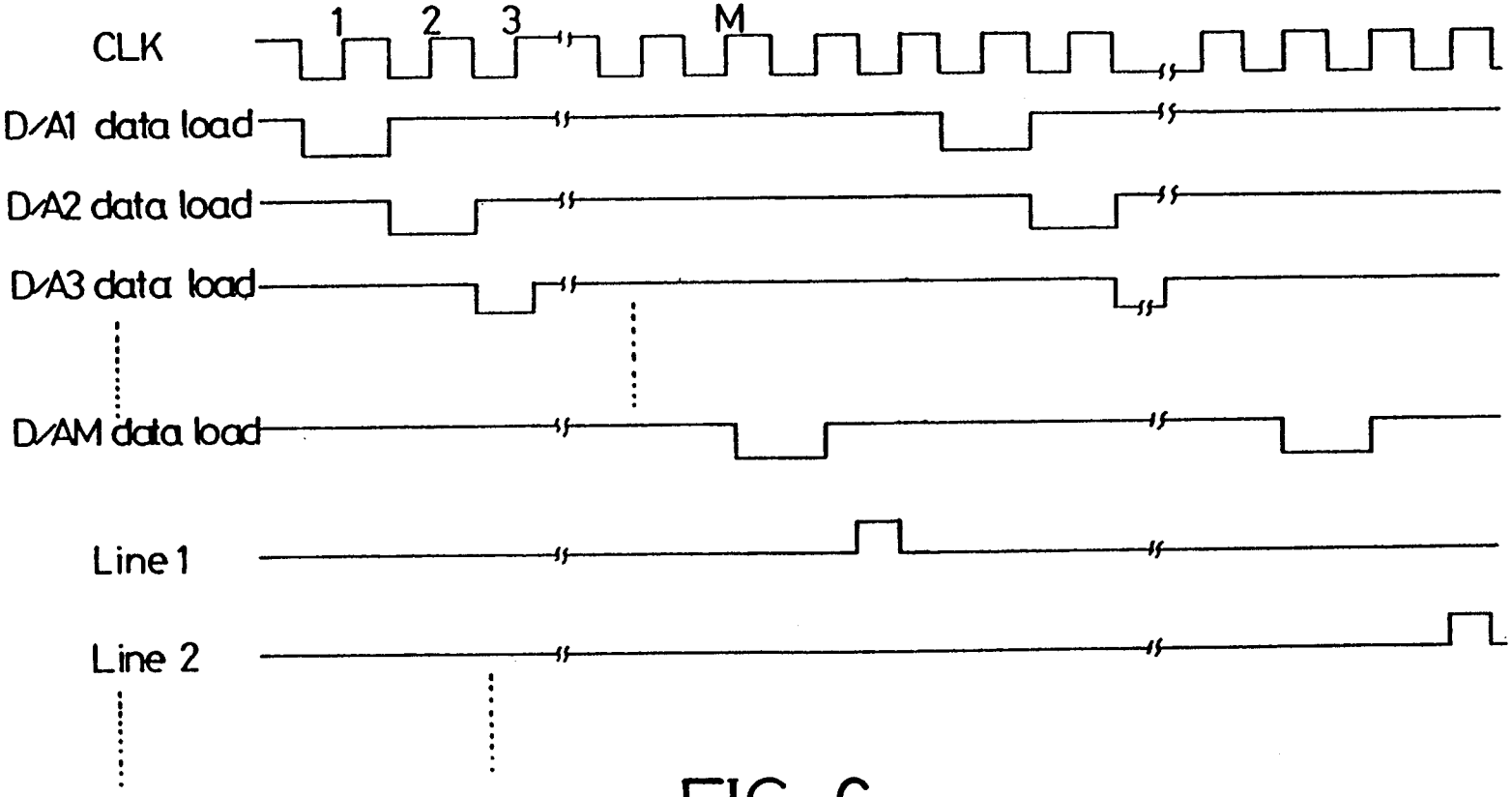
FIG. 6 is a timing relation diagram of individual signals shown in FIG. 4.
Figure 7A:
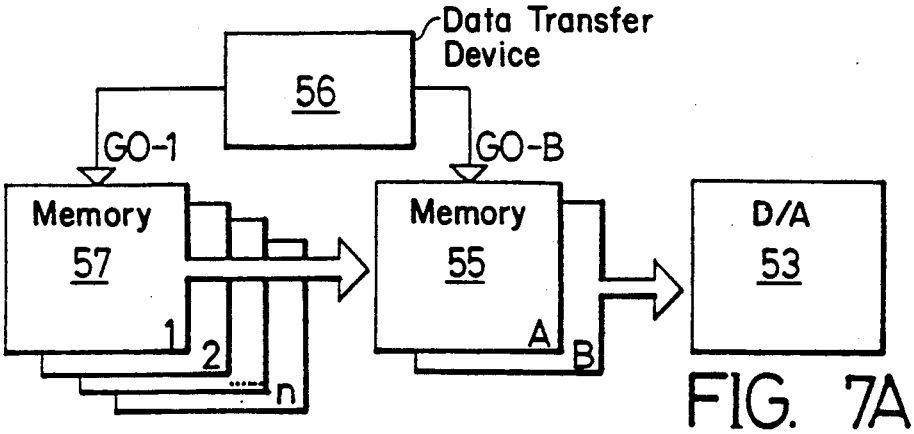
FIGS. 7*a*, 7*b*, 7*c* and 7*d* are diagram blocks showing the manner of image replacement of the present invention.
Figure 7B:
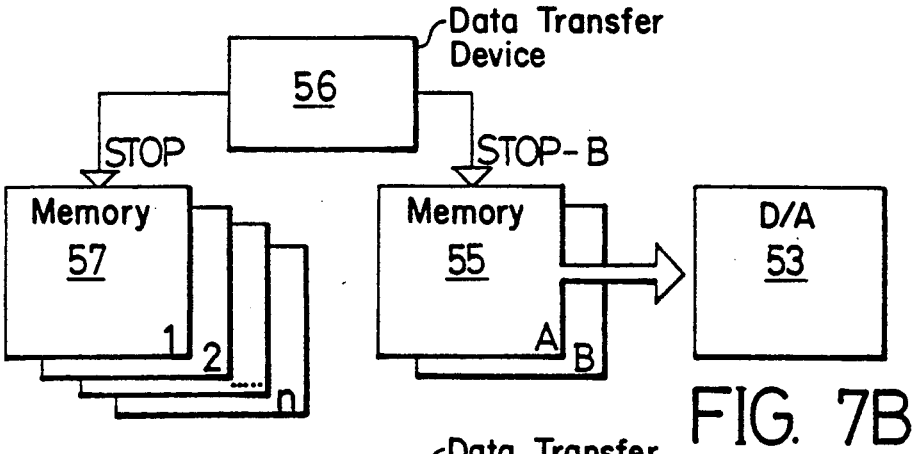
Figure 7C:
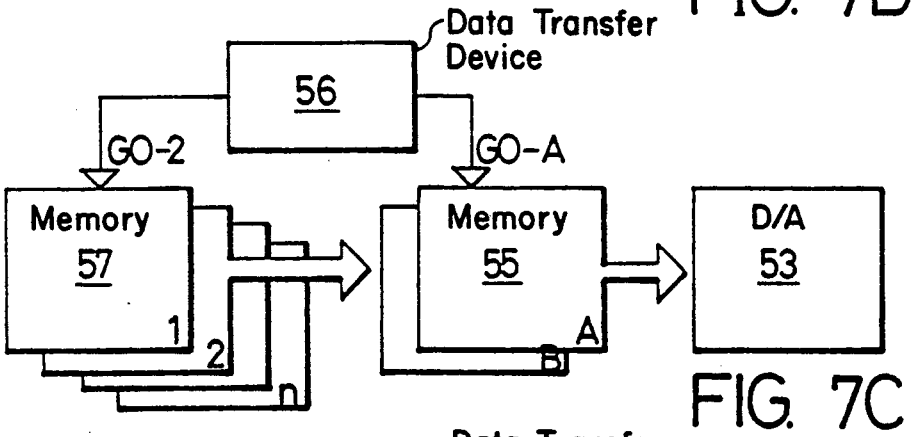
Figure 7D:
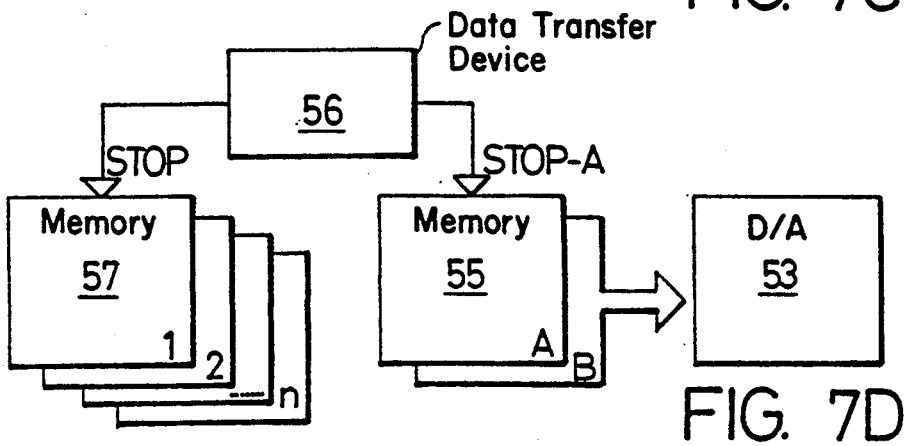

FIG. 6 shows the timing diagram of the circuit of FIG. 4. Since the image data obtained through the image acquisition subsystem are information in different gray levels, the analog signal inputs received by the array of LEDs 4 are inputs having different gray levels such that the effect of displaying an image in different gray levels can be achieved. Through the above approach (i.e. scanning sequentially one column after another, for switching on, transferring and storage, switching off and scanning control), a display of an entire frame can thus be completed.

FIGS. *7a*, *7b*, *7c* and *7d* shows the diagram blocks of images replacement of the present invention. The memory capacity of the display memory subsystem 55 is two times the magnitude of one frame of image data. In the figures, A and B represent the space of one frame of image data, respectively. During the time when the image in the space B is displayed on the array of LEDs, if the image is to be changed, the new image is transferred to and stored in the space A by the transfer device 56, as shown in FIG. *7a*. After completion, the D/A converter array 53 will effectly change to display the image stored in the space A on the array of LEDs, as shown in FIG. *7b*. Similarly, if again the image is to be changed, similar actions will be executed, as shown in FIGS. *7c* and *7d*.

Through alternately reading out from and writing into the display memory subsystem 55, conflict between accesses to the memory can be avoided and high frame rate display on the display array of LEDs can thus be accommodated.

Figure 8:
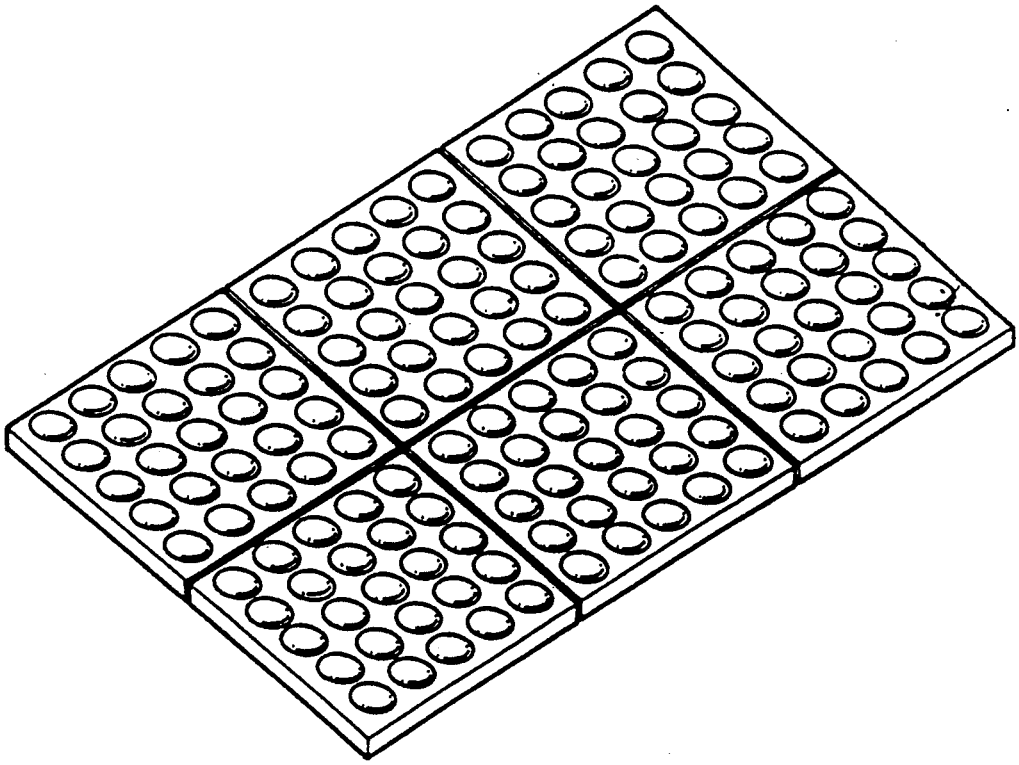
FIG. 8 shows the structure of the display board according to the present invention.

The sign board of the present invention, as shown in FIG. 8, is formed of modules of printed circuit boards (PCBs) with each PCB comprising varying number of LEDs in 4 ×4 or 8×8 array and related driving circuits. The spacing between individual LED being determined depending on the types of the products.

A large scale display is formed by having individual circuit modules arranged laterally and longitudinally just like in the case of mosaic tiles.

Other similar products available in the market have, in addition to different designs and operating principles, different structures. For example, a Japanese product from Sharp and another domestic product from Kuangpao are both large sign boards formed of individual modules, but these products comprise two or even three pieces of PCBs with the first being an LED and the second and third being the driving circuits.

As shown in FIG. 8, the present invention greatly simplifies the circuit because of the improvements in design such that each circuit has only one PCB.

Figure 9:
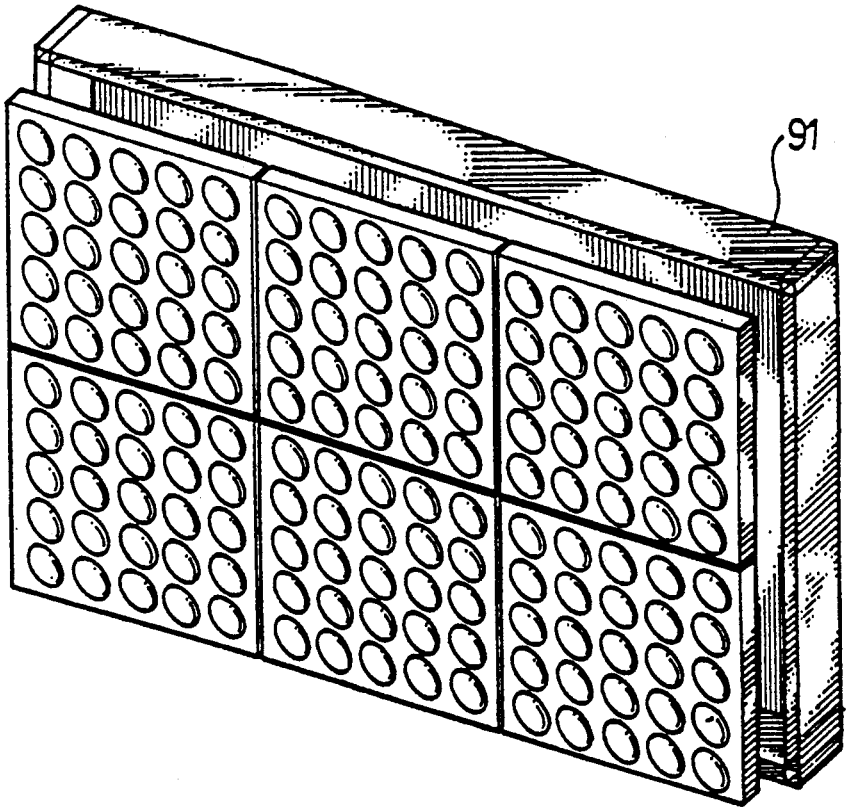
FIG. 9 shows the large scale display board of FIG. 8 with the back fixed by metal supports 91.

As shown in FIG. 9, the assembled large scale sign board is supported and secured in the back by supports of metal plate 91 (or other suitable materials, depending on the type and intended use of the product).

Figure 10:
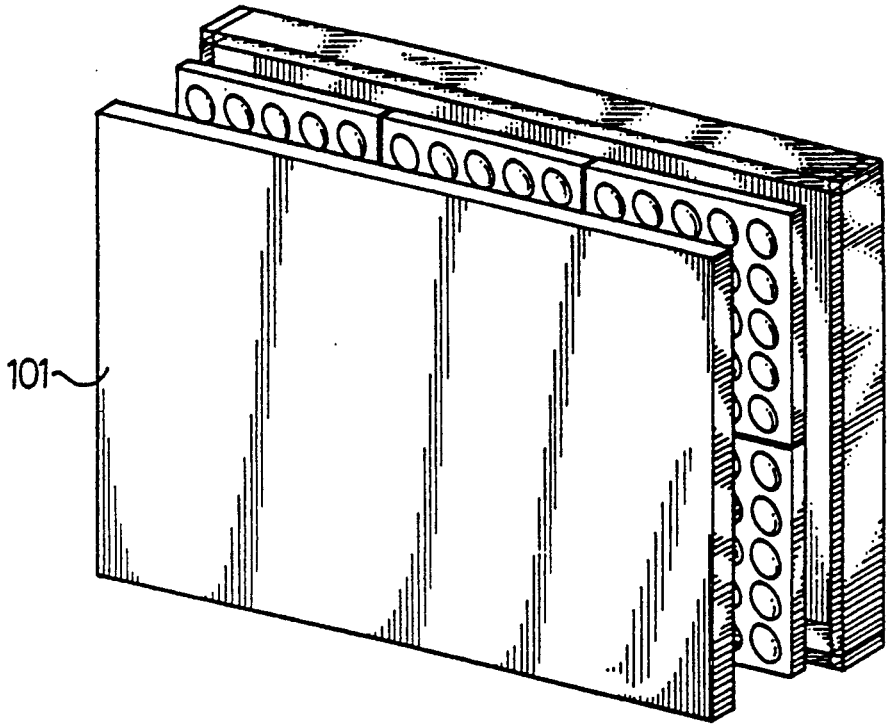
FIG. 10 is a view showing the display board of FIG. 9 covered with a anti-reflection plate 101 after optical treatment.

As shown in FIG. 10, to avoid reflection from the sunlight and the indoor lighting and to meet the needs for viewing at different distances and angles, each of the LEDs is covered with an optically designed and treated anti-reflection plate 101.

The wirings of the whole device have always been most troublesome for like products. A further feature of the present invention is that all the LED arrays are individually supplied with power and can be separately wired such that they are not only safe to use but also convenient to service. In addition, the signal lines for transfer and the control lines are the same in number as other products, but with other products, typical power cords are used for all the lines, transfer being impossible by means of optical fibers or other media.

As various possible embodiments might be made of the above mention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the present invention.

What is claimed is:

1. A large scale electronic display board system for displaying images in response to an image signal, said system comprising:

light emitting diode (LED) display for displaying images in multiple gray levels, said LED display being an N by M array of LEDs, where N and M are integers greater than or equal to 2, having a common ground and a common voltage source; and a current image circuit corresponding to each LED in said LED display for linearly controlling a gray level of said LED, each current image circuit comprising:

a MOSFET large channel width transistor connected to said LED for lighting said LED in accordance with said image signal, a MOSFET control transistor connected to said large channel width transistor for supplying said image signal to said large channel width transistor in response to a control signal, a holding capacitor connected between a drain of said control transistor and said common ground for refreshing said image signal supplied to said large channel width transistor, a MOSFET small channel width transistor connected to said control transistor for supplying said image signal to said control transistor, said large channel width transistor having a channel width which is a multiple of a channel width of said small channel width transistor.

2. The system of claim 1, further comprising:

an operational amplifier for supplying said image signal to said small channel width transistor; and a digital-to-analog converter for supplying said image signal to said operational amplifier.

* * * * *